US011149745B2

(12) United States Patent
Hu et al.

(10) Patent No.: US 11,149,745 B2
(45) Date of Patent: Oct. 19, 2021

(54) WATER-COOLED CASING TREATMENT

(71) Applicant: Ford Global Technologies, LLC, Dearborn, MI (US)

(72) Inventors: Liangjun Hu, Bloomfield Hills, MI (US); Hao Wu, Northville, MI (US); Jianwen James Yi, West Bloomfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 581 days.

(21) Appl. No.: 15/843,210

(22) Filed: Dec. 15, 2017

(65) Prior Publication Data

US 2019/0186502 A1 Jun. 20, 2019

(51) Int. Cl.

| | |
|---|---|
| ***F04D 29/58*** | (2006.01) |
| ***F04D 29/68*** | (2006.01) |
| ***F04D 29/42*** | (2006.01) |
| ***F04D 27/00*** | (2006.01) |
| ***F04D 29/44*** | (2006.01) |
| *F02B 37/00* | (2006.01) |

(52) U.S. Cl.

CPC ..... *F04D 29/5833* (2013.01); *F04D 27/009* (2013.01); *F04D 29/4206* (2013.01); *F04D 29/4213* (2013.01); *F04D 29/444* (2013.01); *F04D 29/584* (2013.01); *F04D 29/685* (2013.01); *F02B 37/00* (2013.01)

(58) Field of Classification Search

CPC ..... F04D 29/5833; F04D 29/4206; F04D 29/4213; F04D 29/444; F04D 29/584; F04D 29/685; F04D 27/009

See application file for complete search history.

(56) References Cited

U.S. PATENT DOCUMENTS

| | | | | |
|---|---|---|---|---|
| 7,010,916 | B2 * | 3/2006 | Sumser | F01D 11/02 415/114 |
| 7,475,539 | B2 * | 1/2009 | Chen | F04D 29/4213 415/144 |
| 7,775,759 | B2 * | 8/2010 | Sirakov | F04D 29/685 415/1 |
| 8,061,974 | B2 | 11/2011 | Gu et al. | |
| 8,424,296 | B2 * | 4/2013 | Burgers | F28D 9/0012 60/298 |
| 8,517,664 | B2 | 8/2013 | Sun et al. | |
| 8,882,444 | B2 * | 11/2014 | Williams | F04D 29/441 415/58.4 |
| 10,215,085 | B2 * | 2/2019 | Yamashita | F02B 39/10 |
| 10,662,949 | B2 * | 5/2020 | Arnold | F04D 29/4213 |
| 2007/0271921 | A1 | 11/2007 | Chen | |
| 2011/0173975 | A1 | 7/2011 | Sun et al. | |
| 2011/0255952 | A1 | 10/2011 | Williams et al. | |
| 2017/0328269 | A1 * | 11/2017 | Yamashita | F04D 29/584 |
| 2017/0370361 | A1 * | 12/2017 | Arnold | F04C 29/122 |

* cited by examiner

*Primary Examiner* — David Hamaoui
*Assistant Examiner* — John S Hunter, Jr.
(74) *Attorney, Agent, or Firm* — Geoffrey Brumbaugh; McCoy Russell LLP

(57) ABSTRACT

Methods and systems are provided for preventing compressor surge while improving compressor efficiency and performance. In one example, a method may include a recirculation passage in a compressor configured with a casing treatment and the recirculation passage being cooled by a cooling jacket within the compressor housing wall. In another example, the recirculation passage includes guide vanes.

17 Claims, 7 Drawing Sheets

WATER-COOLED CASING TREATMENT

FIELD

The present description relates generally to methods and systems for controlling a vehicle engine to mitigate compressor surge and to improve compressor efficiency.

BACKGROUND/SUMMARY

Boosted engines have become increasing popular due to the improved fuel economy and power output gained by incorporating a turbocharger in an engine system. The turbocharger comprises a compressor coupled to a turbine via a drive shaft. The turbine is often exhaust-driven, thus boost is supplied to combustion chambers of the engine system by harnessing energy produced by the engine that would otherwise be released as waste. The rotation of the turbine compels the rotation of the compressor which may be fluidly coupled to an air intake manifold in the engine, thereby delivering boosted air to the engine. The use of a compressor may allow a smaller displacement engine to provide as much power as a larger displacement engine, but with additional fuel economy benefits.

However, compressors are prone to surge. For example, when an operator rapidly tips-out of an accelerator pedal, air flow into the compressor inlet decreases, reducing the forward flow through the compressor while the compressor is still at a high pressure ratio (PR). This may lead to pressure accumulation at the outlet end of the compressor, driving air flow in a reverse direction that may degrade components of the compressor. As another example, compressor surge may occur during high levels of cooled exhaust gas recirculation (EGR), increasing compressor pressure while decreasing mass flow through the compressor.

Various approaches have been developed to address the issue of compressor surge. One example approach is shown by Sun et al, in U.S. 2001/0173975 A1. Therein, a turbocharger with an active casing treatment is disclosed. The active casing treatment includes a bleed port and an injection port in a casing arranged in an intake conduit of a compressor. A recirculation passage surrounds the casing and is fluidly coupled to a bleed port adjacent to an impeller of the compressor at a first end. A second end of the recirculation passage is fluidly coupled to an intake passage of the compressor by a recirculation port. During low mass flow conditions where pressure accumulates downstream of a leading blade of the impeller, air may flow from the impeller region, through the bleed port and recirculation passage in a direction opposite to flow through the intake passage, to enter the intake passage via the recirculation port. The extra air flow into the intake passage may allow the compressor to operate under lower gas flow before surge occurs.

Another example approach to lessen the occurrence of compressor surge is shown by Gu et al. in U.S. Pat. No. 8,061,974 B2. Therein, a compressor is adapted with a variable-geometry ported shroud and a bypass passage. The shroud is adjusted so that a port in the shroud alternates between a first and second meridional locations. When the port is arranged in the first meridional location, air is recirculated from a downstream end of the bypass passage in an upstream direction to return the air to an intake passage of the compressor. This positioning of the port channels additional air flow to the intake passage, alleviating pressure accumulation at an outlet end of the compressor and reducing the likelihood of surge. When the port is adjusted to the second meridional location, air flows in a forward direction through the bypass passage to the impeller, thereby avoiding compressor choke.

However, the inventors herein have recognized potential issues with such systems. As one example, recirculation flow circulates air that is warmed, due to compression, through the compressor intake. This may reduce the density of the boosted air delivered to the combustion chambers of the engine, diminishing the boosting potential of the air and lowering engine efficiency. In another example, the adjustment of the variable—geometry ported shroud tends to include complicated control systems that leads to more expensive production costs.

In one example, the issues described above may be addressed by a method for flowing intake air through a compressor intake passage to an impeller and recirculating a portion of the intake air from the impeller back to an inlet of the compressor intake passage via a set of guiding vanes positioned in a recirculation passage circumferentially surrounding the compressor intake passage. The intake air may be cooled in the recirculation passage via a cooling jacket circumferentially surrounding the recirculation passage. In this way, compressor surge may be mitigated while improving compressor efficiency and engine performance while maintaining a fixed geometry to avoid increased complexity of control and manufacturing costs.

As one example, air recirculated through a compressor inlet may be cooled by a cooling jacket surrounding a recirculation passage. A coolant circulates through the cooling jacket, extracting heat from warmed air through cooled surfaces of the recirculation passage. In order to maximize a cooling effect of the cooling jacket, structures may be arranged in the recirculation passage to direct and prolong contact between the recirculated air and the cooled surfaces.

In this way, compressor surge may be alleviated by extending a lower limit of the low mass flow range for stable operation of the compressor. In addition, engine performance may be improved by increasing the density of the recirculated air, which increases the boosting potential of the air delivered to the combustion chambers of the engine and also improves a fuel economy of the vehicle. The technical effect of cooling the recirculation passage and configuring the recirculation passage with structures to guide air flow is that extension of a surge limit is achieved while improving compressor efficiency.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 3-4C and 7 are shown approximately to scale.

DETAILED DESCRIPTION

Figure 1:
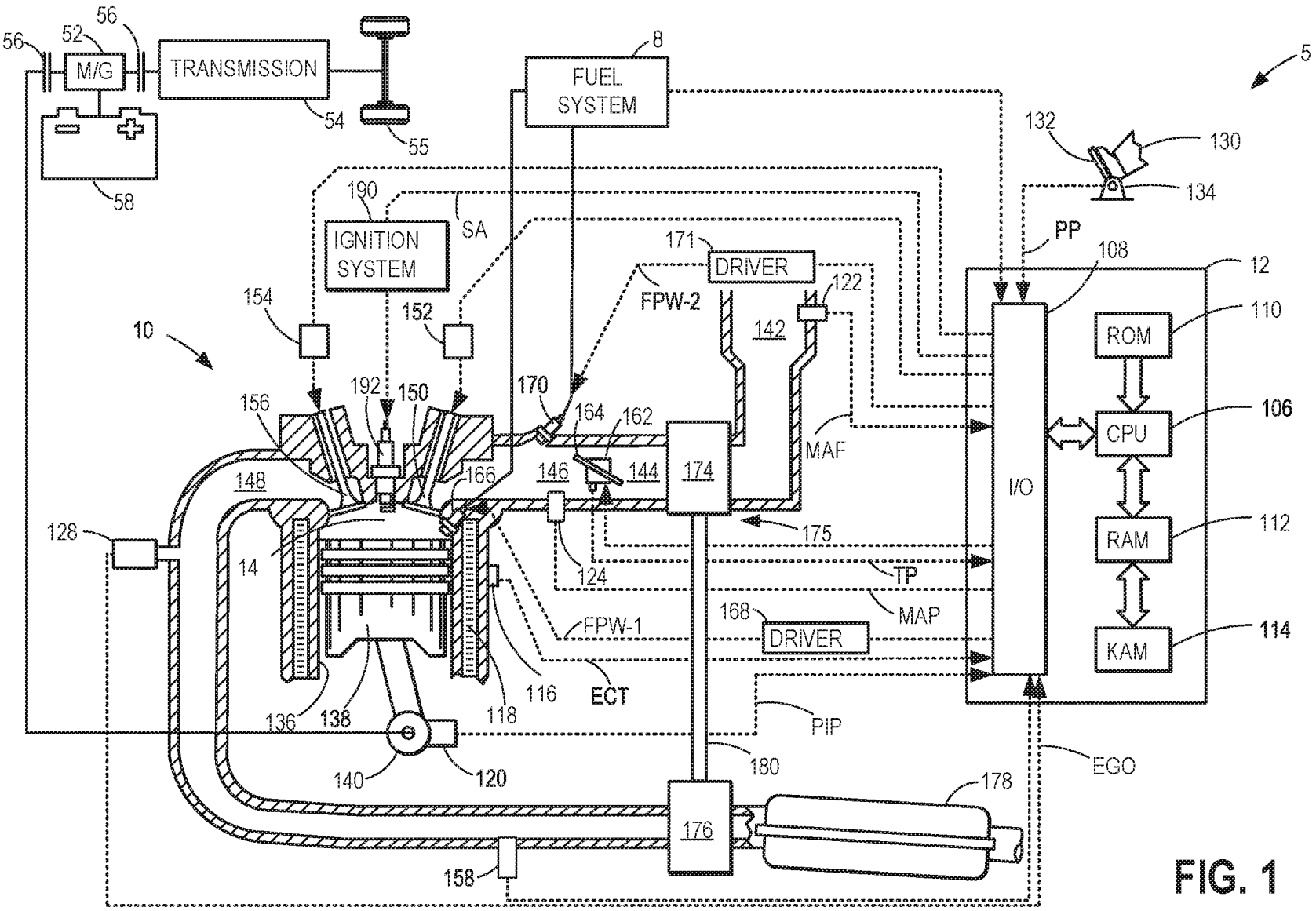
FIG. 1 shows an example engine system for a hybrid vehicle.
Figure 2:
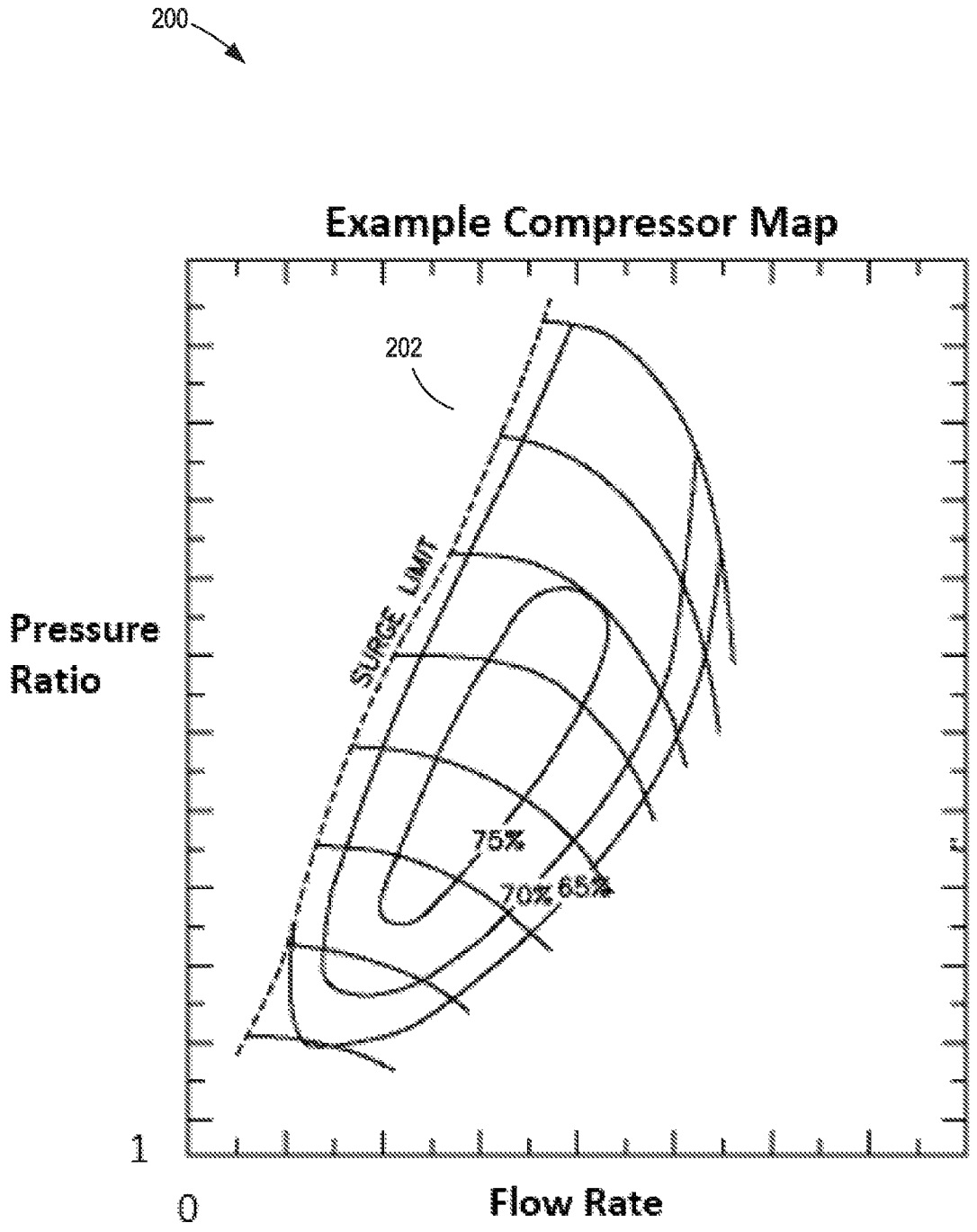
FIG. 2 shows an example compressor map.
Figure 3:
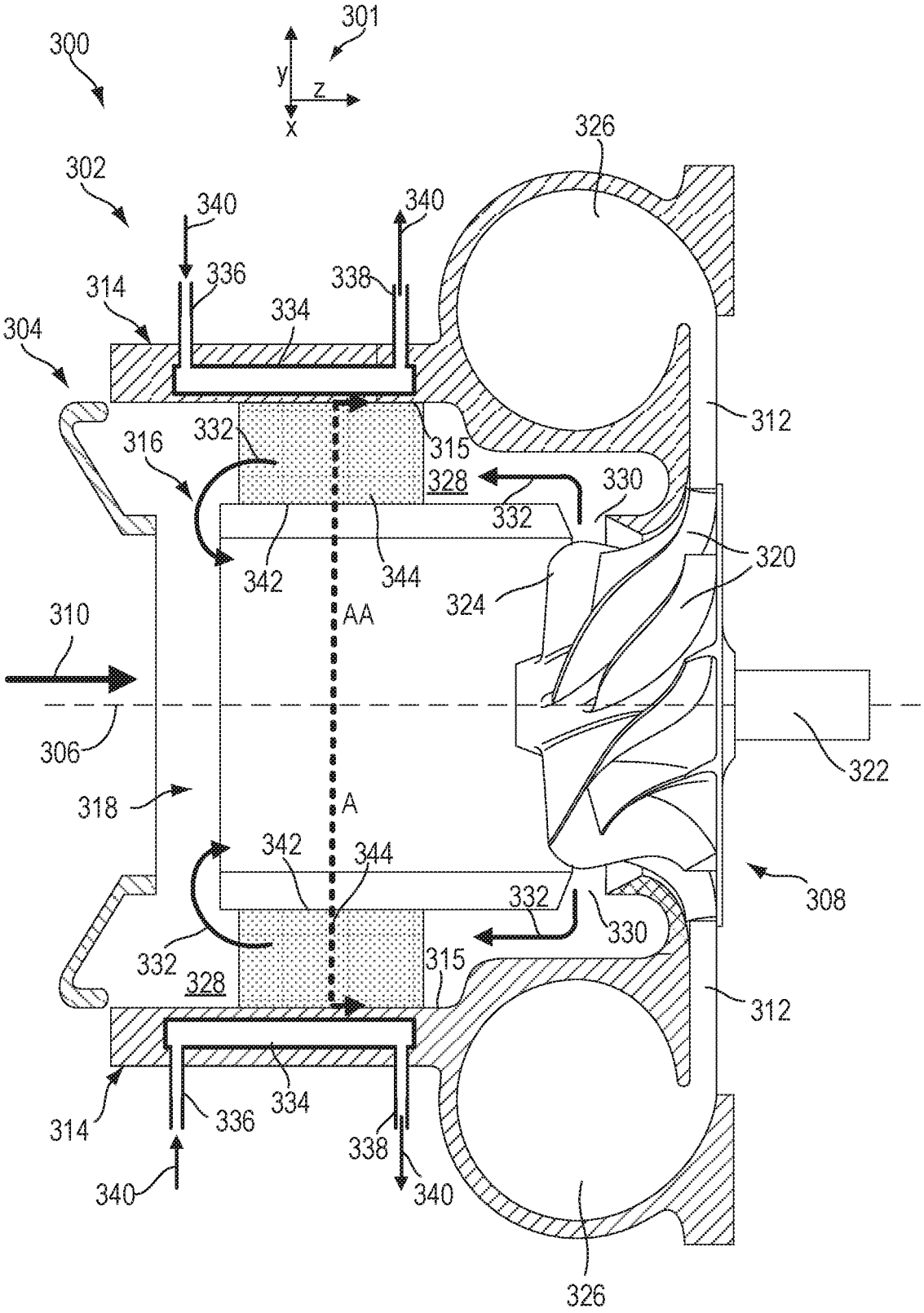
FIG. 3 shows a cross-section view of a compressor adapted with a recirculation passage.
Figure 4C:
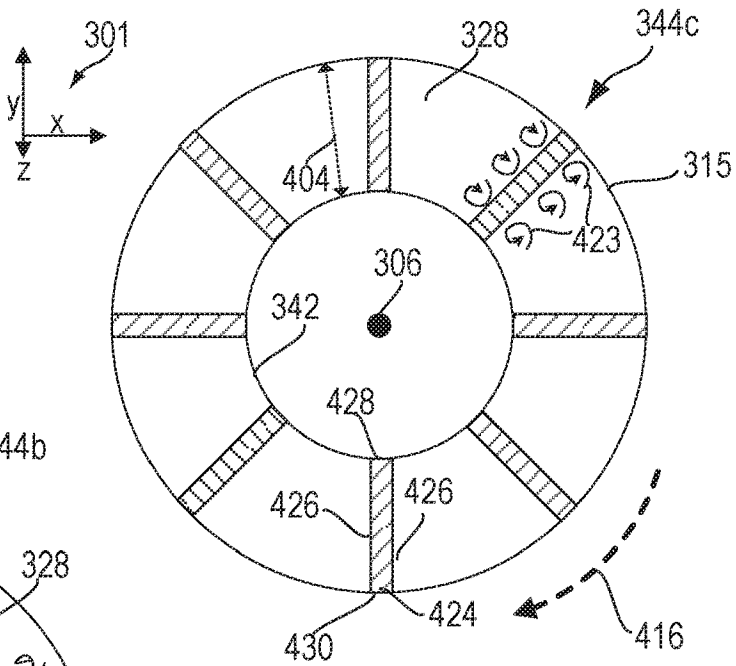
FIG. 4C is a front view of a third embodiment of a set of guiding vanes for a recirculation passage.
Figure 4B:
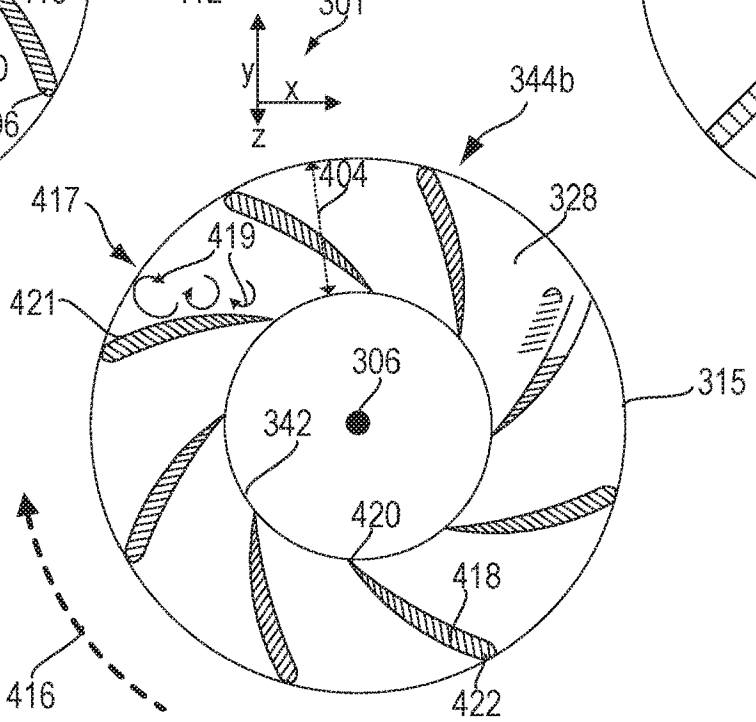
FIG. 4B is a front view of a second embodiment of a set of guiding vanes for a recirculation passage.
Figure 4A:
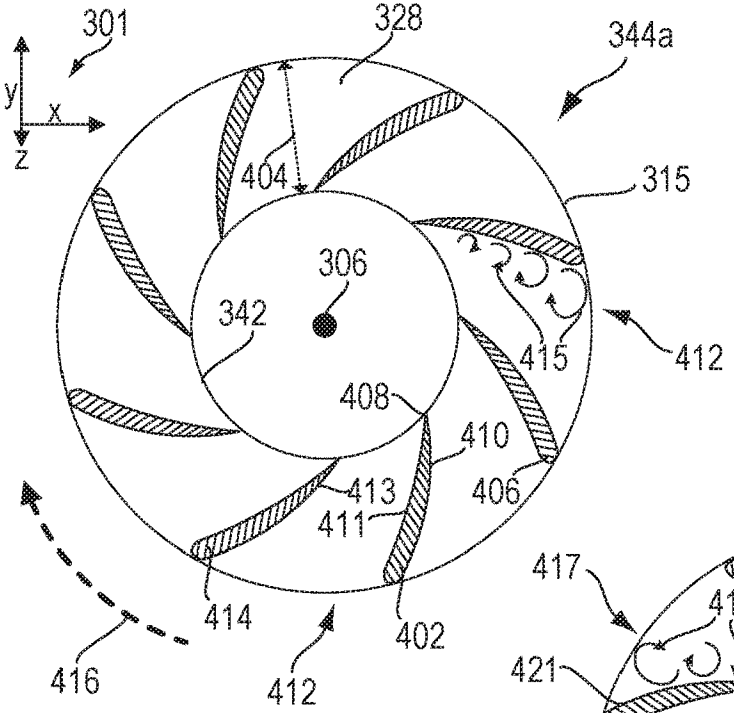
FIG. 4A is a front view of a first embodiment of a set of guiding vanes for a recirculation passage.
Figure 5:
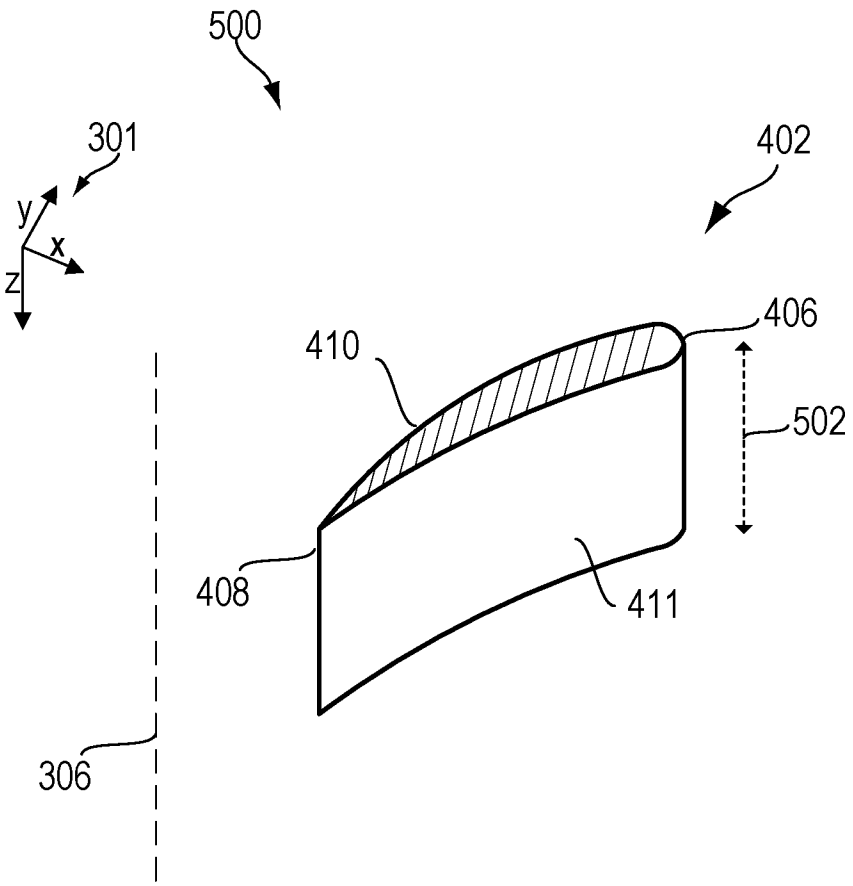
FIG. 5 is an isometric perspective view of a guiding vane.

The following description relates to systems and methods for reducing occurrence of compressor surge by cooling air flow through a recirculation passage of a compressor inlet. One non-limiting example of a hybrid vehicle system including a turbocharged engine is shown in FIG. 1. An example compressor map depicting pressure ratio as a function of air flow rate relative to a surge limit is provided in FIG. 2. The turbocharged engine may utilize an exhaust turbine-driven compressor that may be positioned in an intake passage of the engine. The compressor may include an outer housing with an inlet conduit (e.g., intake passage) enclosing a casing and an impeller (e.g., compressor wheel) disposed at a downstream end of the casing, as illustrated in FIG. 3. A recirculation passage may surround the casing, fluidly coupled to the intake passage by a bleed port. A set of guiding vanes may be arranged within the recirculation passage, encircling the casing and comprising angled guiding vanes to direct air flow. A front view of a first, second, and third embodiment of the set of guiding vanes is shown in FIG. 4A-4C, illustrating different alignments of the guiding vanes relative to a direction of impeller rotation. The geometry of one guiding vane of the set of guiding vanes is depicted in FIG. 5. A wall of the recirculation passage may be cooled with a cooling jacket disposed in an outer housing of the compressor coupled to a cooling loop. A schematic diagram of the cooling loop is shown relative to the positioning of a turbocharger in FIG. 6. A cross-section of an embodiment of the cooling jacket adapted with inner ribs is shown in FIG. 7. In this way, a recirculation passage that cools and channels recirculating air flow during low mass flow conditions may reduce compressor surge and improve compressor efficiency.

Turning now to FIG. 1, an example of a cylinder 14 of an internal combustion engine 10 is illustrated, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one drive wheel 55 of the passenger vehicle via a transmission 54, as described further below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission. The powertrain may be configured in various manners including as a parallel, a series, or a series-parallel hybrid vehicle.

Electric machine 52 receives electrical power from a traction battery 58 to provide torque to vehicle wheels 55. Electric machine 52 may also be operated as a generator to provide electrical power to charge battery 58, for example, during a braking operation.

Cylinder 14 of engine 10 can receive intake air via a series of intake air passages 142, 144, and 146. Intake air passage 146 can communicate with other cylinders of engine 10 in addition to cylinder 14. In some examples, one or more of the intake passages may include a boosting device, such as a turbocharger or a supercharger. For example, FIG. 1 shows engine 10 configured with a turbocharger 175, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as the turbocharger 175. However, in other examples, such as when engine 10 is provided with a supercharger, compressor 174 may be powered by mechanical input from a motor or the engine and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1, or may be alternatively provided upstream of compressor 174.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx, a HC, or a CO sensor, for example. Emission control device 178 may be a three-way catalyst, a NOx trap, various other emission control devices, or combinations thereof.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of a possibility of variable intake cam timing, variable exhaust cam timing, dual independent variable cam timing, or fixed cam timing may be used. Each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at maximum brake torque (MBT) timing to maximize engine power and efficiency. Controller 12 may input engine operating conditions, including engine speed, engine load, and exhaust gas AFR, into a look-up table and output the corresponding MBT timing for the input engine operating conditions. In other examples, combustion may be initiated via compression of injected fuel (e.g., as in a diesel engine).

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW-1 received from controller 12 via an electronic driver 168. In this manner, fuel injector 166 provides what is known as direct injection (hereafter also referred to as "DI") of fuel into cylinder 14. While FIG. 1 shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

Fuel injector 170 is shown arranged in intake passage 146, rather than in cylinder 14, in a configuration that provides what is known as port fuel injection (hereafter referred to as "PFI") into the intake port upstream of cylinder 14. Fuel injector 170 may inject fuel, received from fuel system 8, in proportion to the pulse width of signal FPW-2 received from controller 12 via electronic driver 171. Note that a single driver 168 or 171 may be used for both fuel injection systems, or multiple drivers, for example driver 168 for fuel injector 166 and driver 171 for fuel injector 170, may be used, as depicted.

In an alternate example, each of fuel injectors 166 and 170 may be configured as direct fuel injectors for injecting fuel directly into cylinder 14. In still another example, each of fuel injectors 166 and 170 may be configured as port fuel injectors for injecting fuel upstream of intake valve 150. In yet other examples, cylinder 14 may include only a single fuel injector that is configured to receive different fuels from the fuel systems in varying relative amounts as a fuel mixture, and is further configured to inject this fuel mixture either directly into the cylinder as a direct fuel injector or upstream of the intake valves as a port fuel injector.

Fuel may be delivered by both injectors to the cylinder during a single cycle of the cylinder. For example, each injector may deliver a portion of a total fuel injection that is combusted in cylinder 14. Further, the distribution and/or relative amount of fuel delivered from each injector may vary with operating conditions, such as engine load, knock, and exhaust temperature, such as described herein below. The port injected fuel may be delivered during an open intake valve event, closed intake valve event (e.g., substantially before the intake stroke), as well as during both open and closed intake valve operation. Similarly, directly injected fuel may be delivered during an intake stroke, as well as partly during a previous exhaust stroke, during the intake stroke, and partly during the compression stroke, for example. As such, even for a single combustion event, injected fuel may be injected at different timings from the port and direct injector. Furthermore, for a single combustion event, multiple injections of the delivered fuel may be performed per cycle. The multiple injections may be performed during the compression stroke, intake stroke, or any appropriate combination thereof.

Fuel injectors 166 and 170 may have different characteristics. These include differences in size, for example, one injector may have a larger injection hole than the other. Other differences include, but are not limited to, different spray angles, different operating temperatures, different targeting, different injection timing, different spray characteristics, different locations etc. Moreover, depending on the distribution ratio of injected fuel among injectors 170 and 166, different effects may be achieved.

Fuel tanks in fuel system 8 may hold fuels of different fuel types, such as fuels with different fuel qualities and different fuel compositions. The differences may include different alcohol content, different water content, different octane, different heats of vaporization, different fuel blends, and/or combinations thereof etc. One example of fuels with different heats of vaporization could include gasoline as a first fuel type with a lower heat of vaporization and ethanol as a second fuel type with a greater heat of vaporization. In another example, the engine may use gasoline as a first fuel type and an alcohol containing fuel blend such as E85

(which is approximately 85% ethanol and 15% gasoline) or M85 (which is approximately 85% methanol and 15% gasoline) as a second fuel type. Other feasible substances include water, methanol, a mixture of alcohol and water, a mixture of water and methanol, a mixture of alcohols, etc.

Controller 12 is shown in FIG. 1 as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148; a profile ignition pickup signal (PIP) from a Hall effect sensor 120 (or other type) coupled to crankshaft 140; throttle position (TP) from a throttle position sensor; signal EGO from exhaust gas sensor 128, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature and infer a temperature of catalyst 178 based on the signal received from temperature sensor 158. Controller 12 receives signals from the various sensors of FIG. 1 and employs the various actuators of FIG. 1 to adjust engine operation based on the received signals and instructions stored on a memory of the controller.

As described above, FIG. 1 shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1 with reference to cylinder 14.

A turbocharged vehicle, such as the vehicle 5 of FIG. 1, may experience issues related to low mass flow through a compressor of a turbocharger due to operating limits of the compressor. A low load compressor operator limit will be referred to throughout the following detailed descriptions and may be clarified in conjunction with a compressor map 200 illustrated in FIG. 2, showing flow rate through the compressor as a function of a pressure ratio across the compressor. A surge limit delineates a lower limit air flow for compressor operation. For example, dashed line 202 represents a lower limit boundary that is the surge limit. Compressor surge may occur during low compressor flow conditions, such as rapid engine unloading events, during which the turbine continues to spin at a relatively high speed, pressurizing the air downstream of the compressor. This leads to a high pressure zone at the outlet of the compressor, driving a reversal in the air flow direction that may cause degradation of the turbocharger. Compressor operating efficiency—as depicted by the curved lines marked with percentages—reduces as the operating point nears the surge limit. Operating in the region to the left of dashed line 202 (e.g., with relatively low compressor mass flow and mid-to-high pressure ratio) may result in compressor surge and even lower efficiency. Shifting the surge line to the left may increase the compressor operating efficiency of a given operating point.

The region of stable compressor operation may be extended to the left of the surge limit shown in the compressor map 200 of FIG. 2 by configuring a compressor inlet with elements depicted in FIG. 3 and described in further detail below. Therein, a cross-section 300 of a compressor 302, which may be an example of the compressor 174 of FIG. 1, illustrates an inlet conduit 304 of the compressor 302 with a central axis 306. The central axis 306 may also be a central axis of rotation of an impeller 308. A set of reference axes 301 is provided for comparison between views shown indicating a "y" vertical direction, an "x" horizontal direction, and a "z" lateral direction. A direction of air flow through the inlet conduit is indicated by an arrow 310. The direction of flow may be a reference for the positioning of elements in reference to one another. An element in the path of air flow relative to a reference point is considered downstream of that reference point and an element before the reference point in the path of air flow is considered to be upstream of the said reference point. For example, the impeller 308 is upstream of a diffuser 312 while the diffuser 312 is downstream of the impeller 308.

The inlet conduit 304 may include an outer housing 314 and a casing 316 centered about the central axis 306. The casing 316 may have an annular cross-section, taken in a direction perpendicular to the central axis 306, and is spaced away from an inner surface 315 of the outer housing 314. An intake passage 318 is formed from a channel within the casing 316, extending along the central axis 306 from an upstream end of the inlet conduit 304 to the impeller 308, positioned at a downstream end of the casing 316.

The impeller 308 may have a plurality of impeller blades 320 and may be connected to a turbine, such as turbine 176 of FIG. 1, via a shaft 322 that drives the rotation of the impeller 308. An outlet end of the compressor 302 may be defined as elements of the compressor 302 positioned downstream of a leading edge 324 of the impeller 308. Air that is drawn into the compressor 302 by the rotation of the impeller 308 is decelerated through the diffuser 312 and collected in a volute 326. Deceleration of gas flow may also occur in the volute 326 and cause an increase in pressure in the volute 326, resulting in gas flow to an intake manifold of an engine.

The space between the casing 316 and the inner surface 315 of the outer housing 314 of the inlet conduit 304 may define a recirculation passage 328 that circumferentially surrounds the casing 316 and extends from the upstream end of the inlet conduit 304 to a downstream end. The recirculation passage 328 is shown in FIG. 3 to narrow in width, defined in a direction perpendicular to the central axis 306, at an end proximal to the impeller 308 and adjacent to the volute 326. In other examples of the compressor 302, however, the recirculation passage 328 may have a constant width across an entire length, as measured along the central axis 306, of the recirculation passage 328. The recirculation passage 328 may be fluidly coupled to the intake passage 318 by a casing treatment comprising a bleed port 330. The bleed port 330 is an opening in the downstream end of the casing 316, adjacent to the impeller 308 and downstream of the leading edge 324.

As elaborated above, during conditions when compressor surge may occur, such as at low mass flow conditions, the bleed port 330 may enable a portion of the air travelling through the intake passage 318 to flow from the impeller 308, which may also be a zone of high pressure, to the intake passage 318 via the bleed port 330 and recirculation passage 328. The direction of flow through the recirculation passage 328 is shown by arrows 332 and is opposite in direction to the flow through the inlet conduit 304, as indicated by arrow 310. The higher pressure in the region downstream of the leading edge 324 of the impeller 308 drives flow through the bleed port, alleviating the pressure gradient across the compressor 302 and returning air to the intake passage 318 to flow once again to the impeller 308. Thus, the flow of air striking the leading edge 324 of the impeller 308 may be greater than without the recirculated air bled by the bleed port 330. The additional air flow may enable the compressor 302 to operate with a lower mass flow through the inlet conduit 304 before surge occurs.

The recirculation of air through the recirculation passage 328 of the compressor 302 may prevent compressor operation from approaching or passing the surge limit 202 shown in FIG. 2. However, the air returned to the intake passage 318 may be at least partially compressed by the impeller 308, leading to warming of the air relative to the air drawn into the compressor from an intake passage, such as intake passage 142 of FIG. 1. Warming results in delivery of air of lower density to the intake manifold of the engine that has diminished boost potential, therefore reducing the power output and fuel efficiency of the engine. Even cooling by a charge air cooler, often arranged in the path of air flow between the compressor 302 and the engine to increase the air density, may not sufficiently compensate for the warming of air due to compression.

To address this issue, a wall of the recirculation passage 328, which is also the inner surface 315 of the outer housing 314, may be adapted with a cooling jacket 334. The cooling jacket 334 may be a sleeve disposed within the outer housing 314 that also surrounds the recirculation passage 328. A coolant, such as water or an aqueous solution, may be flowed through the cooling jacket 334 via an inlet 336 and an outlet 338 in a direction indicated by arrows 340. The flow of coolant through the cooling jacket 334 may extract heat by convection from the inner surface 315 of the outer housing 314. The cooled inner surface 315 of the outer housing 314, in turn, draws heat away from the warmed air flowing through the recirculation passage 328 that comes in contact with the inner surface 315 of the outer housing 314. The temperature of the air flowing through the recirculation passage 328 that contacts the inner surface 315 is reduced before returning to the intake passage 318. Details of a cooling loop driving the flow of coolant through the cooling jacket 334 and structures of the cooling jacket 334 will be provided below in descriptions of FIGS. 6 and 7.

If the air flow through the recirculation passage 328 is linear and coaxial with the central axis 306, however, there may be a portion of the air travelling through the recirculation passage 328 that does not contact the inner surface 315 of the outer housing 314 of the compressor 302. For example, 20% of the mass of air channeled through the recirculation passage 328 may flow directly in contact with the inner surface 315 while 80% of the mass of air travels along a path through a central region of the recirculation passage 328 or along an outer surface 342 of the casing 316. In other examples, the cooled air may comprise 10%, 30%, or 50% of the total mass of air depending on dimensions of the recirculation passage 328, such as a width of the recirculation passage 328 as defined in a direction perpendicular to the central axis 306. In order to increase contact between the air in the recirculation passage 328 and the inner surface 315 of the outer housing 314, a set of guiding vanes 344 may be arranged within the recirculation passage 328.

The set of guiding vanes 344 may be arranged in the path of flow through the recirculation passage 328 in a ring around the casing 316. The positioning of the set of guiding vanes 344 may interrupt the linear air flow, creating turbulence that swirls air radially along the horizontal direction, e.g., perpendicular to the central axis 306, so that a larger portion of the air mass passing through the recirculation passage 328 contacts the inner surface 315 of the outer housing 314. The configuration of the set of guiding vanes 344 is elaborated below in descriptions of FIGS. 4A-4C.

Embodiments of the set of guiding vanes 344 are shown in FIGS. 4A-4C from a cross-section taken along a plane formed by the vertical direction and horizontal direction and indicated by dashed line A-AA of FIG. 3. Elements that are in common with previous figures are similarly numbered. FIG. 4A shows a first embodiment of a set of guiding vanes 344*a*. In FIG. 4A, a first guiding vane 402 of the set of guiding vanes 344*a* may extend across a width 404 of the recirculation passage 328 between the inner surface 315 of the outer housing 314 of the compressor 302, with respect to FIG. 3, and the outer surface 342 of the casing 316. The other guiding vanes of the set of guiding vanes 344*a* are identical to the first guiding vane 402 and aspects described for the first guiding vane 402 may be similarly applied to the other guiding vanes in the set of guiding vanes 344*a*. The first guiding vane 402 has a wide end 406 in contact with the inner surface 315 of the outer housing 314 and a tapered end 408 in contact with the outer surface 342 of the casing 316 as well as a first curved wall 410 and a second curved wall 411. The first guiding vane 402 may be angled in the recirculation passage 328 so that the first guiding vane 402 curves in a clockwise direction from the tapered end 408 to the wide end 406 and outwards away from the central axis 306.

An isometric perspective view 500 of the first guiding vane 402 is illustrated in FIG. 5, including a depth 502 of the first guiding vane 402 that aligns with the central axis 306. In one example, the depth 502 of the first guiding vane 402 may extend from an upstream end of the casing 316 to a point along a length of the casing 316 before the recirculation passage 328 narrows, or along a width of the cooling jacket 334, defined along the central axis 306. In examples where the width of the recirculation passage 328 is constant along the entire length of the recirculation passage 328, the depth 502 may extend from the upstream end of the casing 316 to an upstream edge of the bleed port 330. Alternatively, the depth 502 of the first guiding vane 402 may extend 50% or 75% of a portion thereof between the upstream end of the casing 316 and the upstream edge of the bleed port 330. As such, it will be appreciated that the scope of the present disclosure should not be limited by the extension of the depth 502 of the first guiding vane 402 along the length of the casing 316 described herein.

By positioning the set of guiding vanes so that the depth of each guiding vane extends along the length of the casing 316, as well as along a length of the recirculation passage 328, the set of guiding vanes 344 may divide the recirculation passage 328 into individual chambers separated by each guiding vane of the set of guiding vanes. For example, a chamber 412 in the recirculation passage 328 of FIG. 4A may be bound by the outer surface 342 of the casing 316, the inner surface 315 of the outer housing 314, the second curved wall 411 of the first guiding vane 402 and a first curved wall 413 of a second guiding vane 414. The volume within the recirculation chamber 328 is thus divided into chambers, such as the chamber 412, disrupting the laminar flow so that the air swirls in a radial direction that is a same direction as the rotation of the impeller 308, e.g., direction of rotation of the impeller blades 320, where the rotational direction of the impeller is indicated by arrow 416.

For example, air flowing through the chamber 412 forms eddies 415 resulting from friction generated by contact with the curved surfaces. The swirling eddies 415 causes mixing within the chamber 412 so that air flowing through the central region of the chamber 412 deviates from linear flow, coaxial with the central axis 306, and contacts the inner surface 315 of the outer housing 314 during passage through the recirculation chamber 328. By dividing the inner volume of the recirculation passage 328 into individual chambers, the surface area to volume ratio increases in each chamber so that the air flow experiences greater turbulence. The turbulence created by the arrangement of the set of guiding vanes may force increased contact between air flowing through the recirculation passage 328 and the inner surface 315 of the outer housing 314 that is cooled by the cooling jacket 334.

Alternate orientations of the set of guiding vanes 344 are shown in FIGS. 4B and 4C. In a second embodiment of the set of guiding vanes 344*b* of FIG. 4B, a third guiding vane 418 may be angled oppositely from the first guiding vane 402 of FIG. 4A. The third guiding vane 418 may be similarly shaped as the first guiding vane but the third guiding may curve, from a tapered end 420 to a wide end 422, in a counterclockwise direction and outward from the central axis 306. Air flowing through a chamber 417 of the set of guiding vanes 344*b* may be swirled in a direction opposite from the rotational direction of the impeller (indicated by arrow 416), due to friction between air flow and the curved surfaces of the set of guiding vanes 344*b*. Eddies 419 may be generated, causing deviated from linear flow through the chamber 417. The air is thus cooled by increased contact with the inner surface 315 of the outer housing 314 in which the cooling jacket 334 is disposed.

In a third embodiment of the set of guiding vanes 344*c*, each guiding vane may be rectangular, as shown in FIG. 4C. A fourth guiding vane 424 may have straight sides 426 extending from the outer surface 342 of the casing 316 to the inner surface 315 of the outer housing 314. A width of the fourth guiding vane 424, as measured in the horizontal direction, at a first end 428 is equal to a width of a second end 430 of the fourth guiding vane 424. The shape of the fourth guiding vane 424 may not contribute to swirling of the air flow through the recirculation passage 328. Friction between the air and the straight sides 426 of the fourth guiding vane 424, however, may generate turbulent eddies in the laminar flow that prolongs contact between the inner surface 315 of the outer housing 314 and the air flowing past.

By swirling the air in a first direction, e.g., the same direction as the impeller 308 is rotating, eddies 415 may be formed along the second curved wall 411 of each guiding vane of the set of guiding vanes 444 of FIG. 4A. Swirling the air in a second direction, opposite of the first direction, as induced by the orientation of the set of guiding vanes 344 of FIG. 4B, may generate eddies 419 along a first curved wall 421 of each guiding vane of the set of guiding vanes 344. The eddies 419 of FIG. 4B may rotate in an opposite direction from the eddies 415 of FIG. 4A. The straight sides of the set of guiding vanes 344 of FIG. 4C may create eddies 423 on either side of each guiding vane of the set of guiding vanes 344. Thus the turbulent flow generated as air flows through the recirculation passage 328 may be varied by the orientation of the set of guiding vanes 344.

Although each of the embodiments of the set of guiding vanes shown in FIGS. 4A-4C are depicted with eight guiding vanes, other arrangements of the set of guiding vanes 344 may also effectively enhance cooling of the air flowing through the recirculation passage 328. As an example, a set of guiding vanes may have 6-15 guiding vanes, depending on the dimensions of the recirculation passage 328. In another example, a guiding vane of a set of guiding vanes may have different shapes, curvatures, or thicknesses from the examples shown in the present disclosure.

The embodiments of the set of guiding vanes shown in FIGS. 4A-4C may enable increased cooling of the partially compressed air flowing through the recirculation passage 328 by interrupting the linear air flow and decelerating the flow rate. The warmed air is thus contained within the recirculation passage for a longer period of time, enabling increased heat transfer from the air to the cooler inner surface 315 of the outer housing 314. In order to provide continuous cooling, the cooling jacket 334 arranged in the outer housing 314 may be coupled to a cooling loop 602, as shown in a schematic diagram 600 of FIG. 6.

Figure 6:
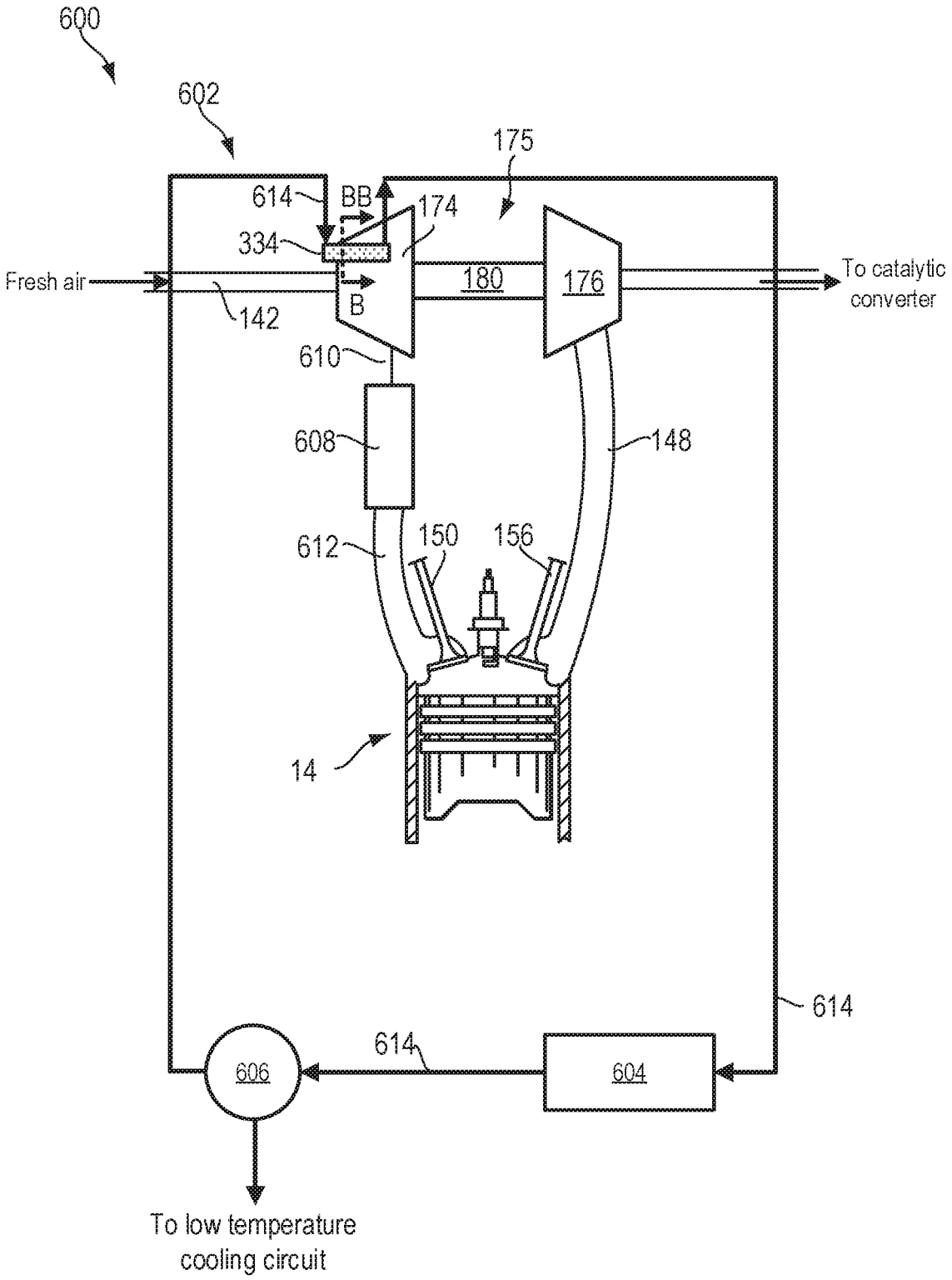
FIG. 6 is a schematic showing a cooling loop coupled to a turbocharger.
Figure 7:
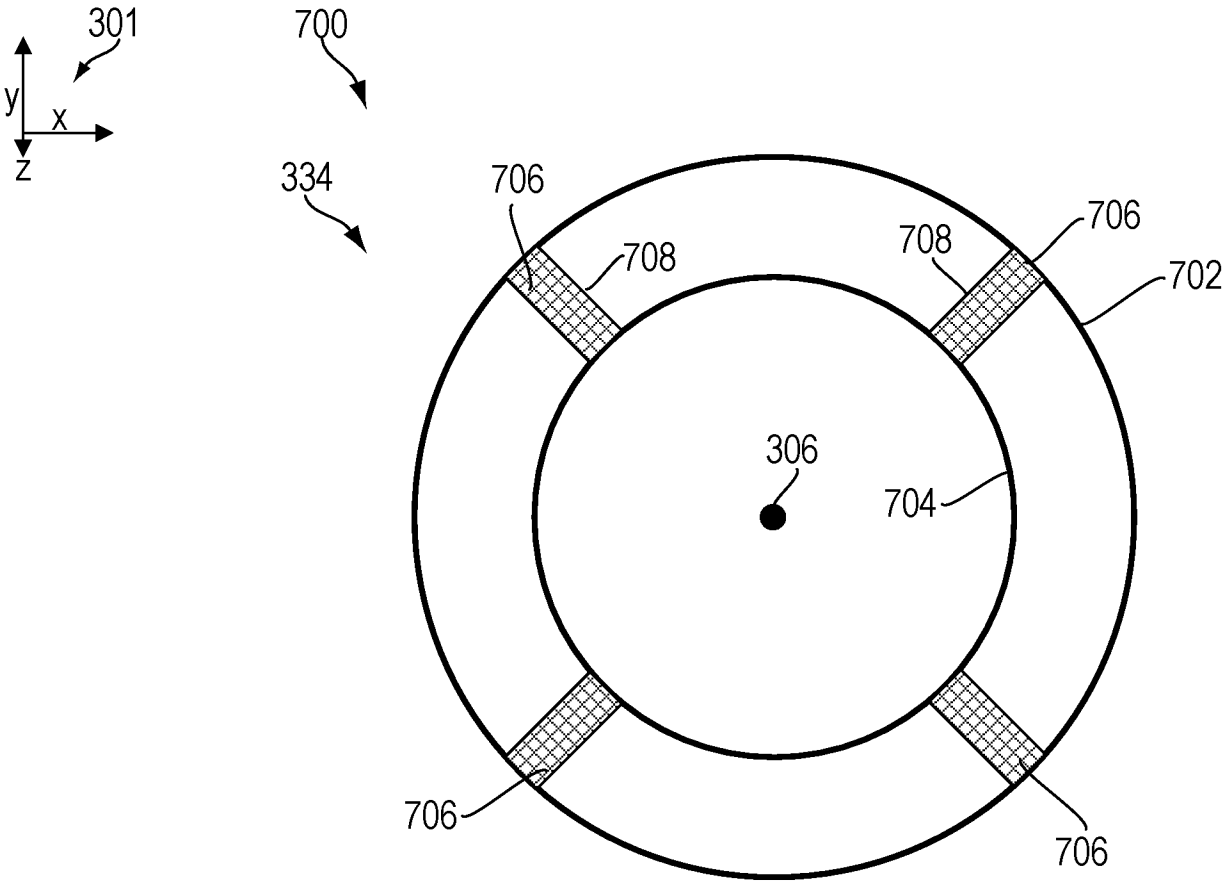
FIG. 7 is a first cross-section of embodiment of a guiding structure for a cooling jacket.

The cooling loop 602 shown in FIG. 6 may include the cooling jacket 334, a heat exchanger 604 that extracts heat from a coolant, such as water, flowing through the cooling loop 602, and a pump 606 that drives the flow of the coolant. A direction of the coolant flow through the cooling loop 602 is indicated by arrows 614. The cooling jacket 334 may extend along an inlet end of the compressor 174 which is coupled to the turbine 176 of the turbocharger 175 of FIG. 1 by the shaft 180. Fresh air is drawn into intake passage 142, compressed by the compressor 174, and then flowed through a charge air cooler (CAC) 608 by way of a boosted air passage 610. The boosted, cooled air is then delivered to the cylinder 14 via a charge air passage 612 connected to intake valve 150. Exhaust gas generated during combustion at the cylinder 14 is channeled out through exhaust valve 156 and to the turbine 176 through the exhaust passage 148. Turbine 176 may be coupled to an exhaust after treatment device, such as a catalytic converter, to remove emissions from the exhaust gas prior to atmospheric emission.

In one example, the pump 606 may be a pump used to circulate coolant in a cooling loop of the engine, such as in the pump of a low temperature cooling circuit of the engine system. Coolant circulated through the cooling loop 602 may be diverted from the low temperature cooling circuit. The low temperature cooling circuit may circulate coolant through a charge air cooler to cool compressed air boosted by the turbocharger, for example. The pump 606 may be a merging point for the cooling loop 602 and the low temperature cooling circuit and coolant flow may be channeled between the cooling loop 602 and the low temperature cooling circuit by a 3-way valve (not shown in FIG. 6). In this way, coolant flow may be divided between the cooling loop 602 and the low temperature cooling circuit or entirely flowed to one or the other. In one example, the 3-way valve may be adjusted based on the cooling demand of the compressor (e.g., the 3-way valve may be moved to a position where coolant flows through cooling loop 602 responsive to charge air or compressed charge air temperature increasing to a threshold temperature). The pump 606 may be activated in response to engine operating conditions such as engine speed and temperature. For example if engine load increases, the pump 606 may turn on when engine speed or temperature passes a pre-set threshold.

As the coolant flows, driven by the pump 606, the coolant may become warmer after passing through the cooling jacket 334 due to heat transfer from warmed air recirculating through a recirculation passage, such as the recirculation passage 328 of FIGS. 3-4C, of the compressor 174. The warmed coolant exiting the cooling jacket 334 then flows to the heat exchanger 604 where heat is extracted from the coolant. In this way, when the coolant returns to an inlet end of the cooling jacket 334, the temperature of the coolant is lower than the temperature of the air flowing through the recirculation passage and the coolant is able to continually draw heat away from the warmed recirculating air. The heat exchanger 604 may be a radiator (also configured to cool coolant circulating in the engine), or the heat exchanger 604 may be a separate air-cooled or coolant-cooled heat exchanger.

The heat extracted from the warmed air may be transferred through a wall of an outer housing of the compressor 174 as well as a shell of the cooling jacket 334. The shell of the cooling jacket 334 may be from a material that readily conducts heat, such as a metal. To maximize a surface area of the cooling jacket 334 available for heat exchange, the cooling jacket 334 may be configured with inner ribs, as shown in a cross-section 700 of an embodiment of the cooling jacket 334 of FIG. 7.

The cross-section 700 may be taken along dashed line B-BB of FIG. 6, depicting a view of the cooling jacket 334 along a plane formed by the vertical direction and the horizontal direction. The cooling jacket 334 may contain the coolant between an outer shell 702 and an inner shell 704. A plurality of ribs 706 may be arranged evenly spaced apart, extending linearly between the outer shell 702 and the inner shell 704 of the cooling jacket 334 as well as extending along a length of the cooling jacket 334, defined by the lateral direction and coaxial with the central axis 306.

The plurality of ribs 706 may be formed from a same material as the outer shell 702 of the cooling jacket 334, such as a heat conducting metal, to enable fast heat transfer across a temperature differential between the warm air in the recirculation passage and the coolant in the cooling jacket. Heat may be conducted through the wall of the outer housing of the compressor 174 to the outer shell 702 of the cooling jacket 334 and to the plurality of ribs 706. Convection arising from the motion of the coolant enables heat exchange from the outer shell 702 of the cooling jacket 334 and from side surfaces 708 of the plurality of ribs 706 to the coolant. Thus, the arrangement of the plurality of ribs 706 within the cooling jacket 334 increases a surface area of conductive material in contact with the coolant that facilitates heat transfer from the warmer air in the recirculation passage to the cooler coolant in the cooling jacket 334.

As noted above for the embodiments of the set of guiding vanes of FIGS. 4A-4C, in other examples of the embodiment of the cooling jacket 334 shown in FIG. 7, the cooling jacket 334 may comprise a different number of ribs included in the plurality of ribs 706. The cooling jacket 334 may have more or fewer ribs than the amount shown in FIG. 7 or, in alternate embodiments, include ribs of different shapes and sizes. Furthermore, each rib of the plurality of ribs 706 may extend along a portion of the length of the cooling jacket 334 rather than extending the entire length of the cooling jacket 334.

In this way, a compressor may be configured to reduce the occurrence of surge by extending the surge limit using fixed elements that are uncontrolled (or minimally controlled). Air may be recirculated through a recirculation passage that alleviates a pressure gradient across the compressor that leads to surge. Additionally, the efficiency of the compressor may be improved by cooling the air in the recirculation passage, warmed by compression, with a cooling jacket surrounding the recirculation passage. By including a set of guiding vanes inside the recirculation passage, contact is prolonged between the air and a surface of the recirculation passage that is cooled by the cooling jacket, allowing more heat transfer from the warm air to the coolant flowing through the cooling jacket. The cooling jacket may include a plurality of ribs that increases a surface area across which heat exchange may occur, further contributing to the increase in density of the boosted air delivered from the compressor to an engine. The combination of the set of guiding vanes arranged in the recirculation passage with cooling of the recirculation passage by a cooling jacket may, in some cases, increase the compressor efficiency by 5-8%. The technical effect of cooling the air recirculated during low mass flow through the compressor is that the likelihood of compressor surge is minimized while a power output and fuel economy of the engine is enhanced.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As one example, a method includes flowing intake air through a compressor intake passage to an impeller; recirculating a portion of the intake air from the impeller back to an inlet of the compressor intake passage via a set of guiding vanes positioned in a recirculation passage circumferentially surrounding the compressor intake passage; and cooling the recirculated intake air in the recirculation passage via a cooling jacket circumferentially surrounding the recirculation passage. In a first example of the method, recirculating the portion of the intake air from the impeller back to the inlet of the compressor intake passage via the set of guiding vanes positioned in the recirculation passage comprises recirculating the portion of the intake from the impeller through a bleed port of a casing at least partially surrounding the impeller, the bleed port fluidically coupled to the recirculation passage. A second example of the method optionally includes the first example, and further includes wherein cooling the recirculated intake air in the recirculation passage via the cooling jacket comprises directing the recirculated intake air along an inner surface of a compressor housing wall via the set of guiding vanes, the cooling jacket positioned in the compressor housing wall. A third example of the method optionally includes one or more of the first and second examples, and further includes, wherein cooling the recirculated intake air in the recirculation passage via the cooling jacket comprises flowing coolant from a pump, through the cooling jacket, and to a heat exchanger. A fourth example of the method optionally includes one or more of the first through third examples, and further includes wherein flowing coolant through the cooling jacket comprises flowing coolant along a plurality of ribs positioned within the cooling jacket.

As an example, a compressor includes an impeller rotatable about a central axis and housed in a compressor housing; a casing at least partially surrounding the impeller, the casing including a bleed port; a cooling jacket positioned in a wall of the compressor housing; a recirculation passage defined by an inner surface of the wall of the compressor housing and an outer surface of the casing, the recirculation passage fluidically coupled to the bleed port; and a set of guiding vanes positioned in the recirculation passage and extending along at least a portion of the cooling jacket. In a first example of the compressor, the cooling jacket includes a plurality of ribs disposed between an inner shell and an outer shell of the cooling jacket. A second example of the compressor optionally includes the first example and further includes wherein each rib of the plurality of ribs of the cooling jacket extends at least along a portion of a length of the cooling jacket. A third example of the compressor optionally includes one or more of the first and second examples, and further includes, wherein the recirculation passage circumferentially surrounds the casing and the wall of the compressor housing circumferentially surrounds the recirculation passage, and the cooling jacket extends circumferentially around the recirculation passage. A fourth example of the compressor optionally includes one or more of the first through third examples, and further includes, wherein each guiding vane of the set of guiding vanes extends across a width of the recirculation passage, the width defined in a direction perpendicular to a central axis of the compressor, between the inner surface of the wall of the compressor housing and the outer surface of the casing. A fifth example of the compressor optionally includes one or more of the first through fourth examples, and further includes, wherein the set of guiding vanes comprises a first guiding vane that has a wide end in contact with the inner surface of the wall of the compressor housing and a tapered end in contact with the outer surface of the casing. A sixth example of the compressor optionally includes one or more of the first through fifth examples, and further includes, wherein the first guiding vane curves in a clockwise direction from the tapered end to the wide end and outwards, away from the central axis. A seventh example of the compressor optionally includes one or more of the first through sixth examples, and further includes, wherein the first guiding vane curves in a counterclockwise direction from the tapered end to the wide end and inwards, towards the central axis. An eighth example of the compressor optionally includes one or more of the first through seventh examples, and further includes, wherein the set of guiding vanes comprises a first guiding vane that is straight and of uniform thickness, and that extends linearly between the inner surface of the wall of the compressor housing and the outer surface of the casing. A ninth example of the compressor optionally includes one or more of the first through eighth examples, and further includes, wherein the first guiding vane has a depth, the depth defined along the central axis, extending from an upstream end of the casing to an edge of the bleed port. A tenth example of the compressor optionally includes one or more of the first through ninth examples, and further includes, wherein the first guiding vane has a depth extending along a portion of a length of the recirculation passage.

As another example, a compressor includes an impeller rotatable about a central axis and housed in a compressor housing; a casing at least partially surrounding the impeller, the casing including a bleed port; a cooling jacket positioned in a wall of the compressor housing, the cooling jacket comprising an inner shell, an outer shell, and a plurality of ribs each extending linearly between the outer shell and the inner shell and extending along a length of the cooling jacket; a recirculation passage defined by an inner surface of the wall of the compressor housing and an outer surface of the casing, the recirculation passage fluidically coupled to the bleed port; and a set of guiding vanes positioned in the recirculation passage and extending along at least a portion of the cooling jacket and dividing an inner volume of the recirculation passage into individual chambers. In a first example of the compressor, a first individual chamber of the recirculation passage is formed from a first guiding vane surface of a first guiding vane of the set of guiding vanes, a second guiding vane surface of a second guiding vane of the set of guiding vanes, the outer surface of the casing, and the inner surface of the wall of the compressor housing. A second example of the compressor optionally includes the first example and further includes wherein each guiding vane of the set of guiding vanes comprises an airfoil shape. A third example of the compressor optionally includes one or more of the first and second examples, and further includes, wherein each guiding vane of the set of guiding vanes comprises a rectangular cross-section shape.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method, comprising:

flowing intake air through a compressor intake passage to an impeller;

recirculating a portion of the intake air from the impeller back upstream relative to the flowing intake air to an inlet of the compressor intake passage via a recirculation passage circumferentially surrounding the compressor intake passage, the recirculation passage forming a cylindrical sleeve circumferentially surrounding the compressor intake passage and extending coaxial with the compressor intake passage as the recirculation passage extends away from the impeller towards the inlet of the compressor intake passage, a set of guiding vanes positioned in the recirculation passage; and cooling the recirculated intake air in the recirculation passage via a cooling jacket which comprises ribs, and the cooling jacket forming a cylindrical sleeve circumferentially surrounding the recirculation passage, the cooling jacket extending coaxial with the recirculation passage and from a first port to a second port, the first port positioned upstream of the impeller relative to the flowing intake air, and the second port located upstream of the first port relative to the flowing intake air; and creating turbulence in air within the recirculation passage using a set of guiding vanes when the air is positioned on an opposite side of a compressor housing wall from the ribs of the cooling jacket, and wherein the recirculation passage, the guide vanes, and a primary length of the plurality of ribs extend coaxial with a central axis of the compressor intake passage.

2. The method of claim 1, wherein recirculating the portion of the intake air from the impeller back to the inlet of the compressor intake passage via the set of guiding vanes positioned in the recirculation passage comprises, drawing air from the impeller through a bleed port of a casing at least partially surrounding the impeller, the bleed port fluidically coupled to the recirculation passage.

3. The method of claim 2, wherein cooling the recirculated intake air in the recirculation passage via the cooling jacket comprises directing the recirculated intake air along an inner surface of the compressor housing wall via the set of guiding vanes, the cooling jacket positioned within the compressor housing wall on an opposite side of the set of guiding vanes.

4. A compressor, comprising:

an impeller rotatable about a central axis and housed in a compressor housing;

an intake passage leading to a casing which at least partially surrounds the impeller, the casing including a bleed port;

a cooling jacket positioned within an inner surface and an outer surface of a wall of the compressor housing and a plurality of ribs positioned within a liquid coolant passage of the cooling jacket, the cooling jacket extending along a first length of the inner surface of the wall of the compressor housing, the cooling jacket forming a cylindrical sleeve circumferentially surrounding a recirculation passage, and the cooling jacket extending coaxial with the recirculation passage from a first port to a second port, the first port positioned upstream of the impeller relative to intake passage flow, and the second port located upstream of the first port relative to the intake passage flow;

the recirculation passage defined by the inner surface of the wall of the compressor housing and an outer surface of the casing, the recirculation passage fluidically coupled to the bleed port, the recirculation passage forming a cylindrical sleeve circumferentially surrounding the intake passage and extending coaxial with the intake passage as the recirculation passage extends away from the impeller towards an inlet of the intake passage; and a set of guiding vanes positioned in the recirculation passage and at least a portion of the set of guiding vanes extending along the first length of the inner surface of the wall of the compressor housing as the cooling jacket but on an opposite side of the wall of the compressor housing; and wherein the plurality of ribs are disposed in the liquid coolant passage within the wall of the compressor housing, and a primary length of the plurality of ribs extend coaxial with recirculation passage.

5. The compressor of claim 4, wherein each rib of the plurality of ribs of the cooling jacket extends at least along a portion of a length of the cooling jacket.

6. The compressor of claim 4, wherein each guiding vane of the set of guiding vanes extends across a width of the recirculation passage, the width defined in a direction perpendicular to a central axis of the compressor, between the inner surface of the wall of the compressor housing and the outer surface of the casing.

7. The compressor of claim 6, wherein each of the set of guiding vanes comprises a wide end in contact with the inner surface of the wall of the compressor housing and a tapered end narrower than the wide end and in contact with the outer surface of the casing.

8. The compressor of claim 7, wherein the set of guiding vanes curves in a clockwise direction from the tapered end at an inner side of the recirculation passage to the wide end at an outer side of the recirculation passage.

9. The compressor of claim 7, wherein the set of guiding vanes curves in a counterclockwise direction from the tapered end at an inner side of the recirculation passage to the wide end at an outer side of the recirculation passage.

10. The compressor of claim 7, wherein the set of guiding vanes has a depth, the depth defined along the central axis, extending from an upstream end of the casing past the plurality of ribs to an edge of the bleed port, and the plurality of ribs extend coaxial with the guide vanes and the central axis.

11. The compressor of claim 7, wherein the set of guiding vanes has a depth extending along a portion of a length of the recirculation passage and past the plurality of ribs.

12. The compressor of claim 6, wherein the set of guiding vanes comprises a first guiding vane that is straight and of uniform thickness, and that extends linearly between the inner surface of the wall of the compressor housing and the outer surface of the casing.

13. A compressor, comprising:

an impeller rotatable about a central axis and housed in a compressor housing;

an intake passage leading to a casing which at least partially surrounds the impeller, the casing including a bleed port;

a cooling jacket positioned within a cavity between an inner surface and an outer surface of a wall of the compressor housing, the cooling jacket comprising a liquid coolant passage between an inner shell and an outer shell, and a plurality of ribs within the liquid coolant passage each extending linearly between the outer shell and the inner shell and extending along a first length of the wall of the compressor housing, the cooling jacket forming a cylindrical sleeve circumferentially surrounding a recirculation passage, and the cooling jacket extending coaxial with the recirculation passage from a first port to a second port, the first port positioned upstream of the impeller relative to intake passage flow, and the second port located upstream of the first port relative to the intake passage flow;

the recirculation passage defined by the inner surface of the wall of the compressor housing and an outer surface of the casing, the recirculation passage fluidically coupled to the bleed port, the recirculation passage forming a cylindrical sleeve circumferentially surrounding the intake passage and extending coaxial with the intake passage as the recirculation passage extends away from the impeller towards an inlet of the intake passage; and a set of guiding vanes positioned in the recirculation passage, at least a portion of the set of guiding vanes extending along the first length of the wall of the compressor housing as the plurality of ribs but on an opposite side of the wall of the compressor housing from the plurality of ribs, and the set of guiding vanes dividing an inner volume of the recirculation passage into individual chambers, wherein a primary length of the plurality of ribs extend coaxial with a central axis of the intake passage, extend along the cooling jacket, and are evenly spaced apart.

14. The compressor of claim 13, wherein a first individual chamber of the recirculation passage is formed from a first guiding vane surface of a first guiding vane of the set of guiding vanes, a second guiding vane surface of a second guiding vane of the set of guiding vanes, the outer surface of the casing, and the inner surface of the wall of the compressor housing.

15. The compressor of claim 14, wherein each guiding vane of the set of guiding vanes comprises an airfoil shape.

16. The compressor of claim 14, wherein each guiding vane of the set of guiding vanes comprises a rectangular cross-section shape and extends coaxial with the recirculation passage, and the plurality of ribs extends coaxial with the recirculation passage.

17. The compressor of claim 13, wherein the liquid coolant passage is formed by the inner shell and the outer shell within a cavity within the wall of compressor housing, and the inner shell, the outer shell, and the plurality of ribs are made of metal.

* * * * *